US008567614B2

(12) United States Patent
Sankey et al.

(10) Patent No.: US 8,567,614 B2
(45) Date of Patent: Oct. 29, 2013

(54) COUNTER DISPLAY FOR SECURELY DISPLAYING MERCHANDISE

(75) Inventors: James K. Sankey, Charlotte, NC (US); Larry T. McKinney, Huntersville, NC (US); Michael R. Johnston, Waxhaw, NC (US); Gregory C. Schultz, Huntersville, NC (US); Kai-Sheng Cheng, Charlotte, NC (US); Mitchell S. Goldstein, Rock Hill, SC (US)

(73) Assignee: InVue Security Products Inc., Charlotte, NC (US)

( * ) Notice: Subject to any disclaimer, the term of this patent is extended or adjusted under 35 U.S.C. 154(b) by 242 days.

(21) Appl. No.: 12/969,841

(22) Filed: Dec. 16, 2010

(65) Prior Publication Data

US 2011/0147324 A1 Jun. 23, 2011

Related U.S. Application Data

(60) Provisional application No. 61/289,162, filed on Dec. 22, 2009.

(51) Int. Cl.

| | |
|---|---|
| ***A47F 5/04*** | (2006.01) |
| ***A47F 7/024*** | (2006.01) |
| ***E05B 73/00*** | (2006.01) |

(52) U.S. Cl.

USPC ..... 211/7; 211/85.2

(58) Field of Classification Search

USPC ..... 211/197, 1.3, 7, 57.1, 59.1, 196, 205, 211/85.3, 85.2, 168, 163, 183, 175, 71.01; 70/14, 57.1, 51, 158, 431; 248/127, 248/146; 206/6.1, 566, 301

See application file for complete search history.

(56) References Cited

U.S. PATENT DOCUMENTS

| | | | | | |
|---|---|---|---|---|---|
| 338,923 | A | * | 3/1886 | Carr | 211/171 |
| 896,990 | A | * | 8/1908 | Hill | 248/125.3 |
| 1,563,137 | A | * | 11/1925 | Amsler | 248/158 |
| 1,757,600 | A | * | 5/1930 | Sprowle | 211/64 |
| 2,784,848 | A | * | 3/1957 | Senne | 211/196 |
| 3,424,317 | A | * | 1/1969 | Singer | 211/167 |
| 3,788,489 | A | * | 1/1974 | Levinthal | 211/163 |
| 3,934,727 | A | | 1/1976 | Brefka | |
| 4,390,099 | A | * | 6/1983 | Trautlein et al. | 211/4 |
| 4,468,421 | A | * | 8/1984 | Wang | 428/8 |
| 4,606,466 | A | | 8/1986 | Fredrickson | |
| 5,015,510 | A | * | 5/1991 | Smith | 428/18 |
| 5,150,874 | A | * | 9/1992 | Spiegel et al. | 248/514 |

(Continued)

*Primary Examiner* — Jennifer E Novosad

(74) *Attorney, Agent, or Firm* — InVue Security Products Inc.

(57) ABSTRACT

A counter display includes a pedestal adapted to be positioned on a support surface and at least one lockable display arm for securely displaying items of merchandise suspended from the display arm. The display arm has an elongate rod for supporting the items of merchandise thereon and a mounting end for mounting the display arm on the pedestal. The rod has a free end opposite the mounting end for loading the items of merchandise on the rod and for removing the items of merchandise from the rod. An end assembly is disposed on the display arm adjacent the free end of the rod and is movable between a locked position for preventing items of merchandise from being removed from the rod and an unlocked position for permitting items of merchandise to be removed from the rod. A lock mechanism releasably locks the end assembly on the display arm. Another lock mechanism releasably locks the display arm on the pedestal. Another lock mechanism locks a removable cover on the pedestal such that the display arm cannot be removed from the pedestal unless the cover is removed from the pedestal.

18 Claims, 7 Drawing Sheets

(56) References Cited

U.S. PATENT DOCUMENTS

| | | | | |
|---|---|---|---|---|
| 5,458,249 | A * | 10/1995 | Shang-Lu | 211/197 |
| 5,845,414 | A * | 12/1998 | Ohsugi | 34/239 |
| 5,848,710 | A * | 12/1998 | Pomper | 211/85.2 |
| 6,003,685 | A | 12/1999 | Malin | |
| 6,116,563 | A * | 9/2000 | Tsai | 248/512 |
| 6,241,105 | B1 * | 6/2001 | Pomper | 211/85.2 |
| 6,474,478 | B1 | 11/2002 | Huehner et al. | |
| 6,659,291 | B2 | 12/2003 | Huehner et al. | |
| 6,702,129 | B1 * | 3/2004 | Harris | 211/196 |
| 6,902,139 | B2 * | 6/2005 | Wang | 248/122.1 |
| 6,948,629 | B1 * | 9/2005 | McClay | 211/196 |
| 7,007,810 | B2 | 3/2006 | Huehner et al. | |
| 7,131,542 | B2 * | 11/2006 | Sedon et al. | 211/59.1 |
| 7,165,689 | B2 * | 1/2007 | McDaniel | 211/165 |
| 7,178,678 | B2 | 2/2007 | Mansfield et al. | |
| 7,207,450 | B1 * | 4/2007 | Franklin et al. | 211/205 |
| 7,392,673 | B2 | 7/2008 | Fawcett et al. | |
| 7,703,308 | B2 | 4/2010 | Nagelski | |
| 7,708,153 | B2 | 5/2010 | Mansfield et al. | |
| 2005/0082244 | A1 * | 4/2005 | Ho | 211/85.23 |
| 2006/0065613 | A1 * | 3/2006 | McKay | 211/85.2 |
| 2008/0169250 | A1 | 7/2008 | Nagelski | |
| 2008/0209960 | A1 * | 9/2008 | Nagelski | 70/57.1 |
| 2010/0199538 | A1 | 8/2010 | Roberts et al. | |
| 2010/0223965 | A1 | 9/2010 | Richardson et al. | |

* cited by examiner

COUNTER DISPLAY FOR SECURELY DISPLAYING MERCHANDISE

CROSS-REFERENCE TO RELATED APPLICATION

This non-provisional application claims the benefit of U.S. Provisional Patent Application No. 61/289,162, filed Dec. 22, 2009, the entire disclosure of which is incorporated herein by reference.

FIELD OF THE INVENTION

This invention relates generally to apparatus for securely displaying items of merchandise on a counter, table, shelf or similar generally horizontal support surface. More particularly, the invention is a counter display including at least one lockable display arm for securely displaying items of merchandise suspended from the display arm. In one embodiment, a display arm is locked onto a pedestal of the counter display and includes a locking end assembly for preventing unauthorized removal of the items of merchandise from the display arm, while permitting the items of merchandise to be bulk loaded onto the display arm and bulk unloaded from the display arm.

BACKGROUND AND RELATED ART

Counter displays are utilized in retail stores and shops to display relatively small items of merchandise. Typically, the counter display is placed on a counter, table shelf or similar generally horizontal support surface, and the items of merchandise are suspended from a display arm, wire, hook, rod or the like (collectively referred to herein as "display arm"). The counter display provides an aesthetic and organized display area on the support surface that allows potential purchasers to conveniently view and handle the items of merchandise without assistance from sales personnel. The items of merchandise are typically retained within individual packaging or within a transparent secure container, sometimes referred to or "keeper," that is configured to be suspended from a display arm of the counter display. In most instances, the counter display is not secured to the support surface and the items of merchandise are not secured on the display arm. As a result, the merchandise is vulnerable to theft. In some instances, however, the value of the items of merchandise warrants the use of a counter display having one or more anti-theft features.

It is known to provide a merchandise display device with an adhesive layer or mechanical fasteners to secure the device to a support surface. It is also known to provide the display arm of a merchandise display hook that supports "high risk" items of merchandise with an anti-sweep feature to prevent a shoplifter from removing (e.g. "sweeping") the merchandise from the display arm. Known anti-sweep features include an S-bend or a mechanical time delay mechanism positioned adjacent the free end of the display arm to increase the amount of time required to remove each item of merchandise from the display hook. It is also known to provide a display hook with a locking device positioned on the display arm between the free end and the items of merchandise. Similarly, it is known to provide a locking end assembly on the free end of the display arm for preventing removal of the items of the merchandise without the assistance of sales personnel. The S-bend and time delay mechanism types of theft protection increase the amount of time required to remove an item of merchandise from the display arm without requiring the assistance of sales personnel, while the locking device and locking end assembly require a special key and the assistance of sales personnel to remove an item of merchandise from the display arm. S-bends and time delay mechanisms do not permit bulk loading of items of merchandise onto the display arm and bulk unloading of the items from the display arm, while certain locking devices and locking end assemblies do permit bulk loading and bulk unloading.

Anti-sweep features, and in particular S-bends and time delay mechanisms, are generally effective for reducing or preventing the unauthorized removal of multiple items of merchandise from a display arm. Locking devices and locking end assemblies, however, are generally effective for preventing the theft of even one item of merchandise from a display arm. Accordingly, determined shoplifters have resorted to forcibly removing the display arm along with the items of merchandise from the display support. Typically, the display arm including the items of merchandise may be removed by tilting or angling the display hook sufficiently to disengage the mounting structure of the display hook from the display support. In a particular example, the display hook includes a pair of mounting pegs, referred to herein as "antlers," that are inserted through apertures formed in the display support. In this instance, the display hook is commonly known as a "peg hook" and the display support is commonly referred to as "pegboard." The peg hook can be provided with a locking base adjacent the pegboard to prevent theft of the display arm and merchandise. The locking base prevents the peg hook from being tilted or angled sufficiently to disengage the antlers from the apertures in the pegboard, thereby preventing the display arm from being removed from the display support along with the items of merchandise.

Although an anti-sweep feature, locking device, locking end assembly and locking base have all been utilized alone or in combination in conjunction with a display hook, no combination of these theft prevention components is known to have been utilized in conjunction with a counter display. In particular, it has not previously been known to provide a display arm of a counter display with a locking base in combination with a locking end assembly. It has previously been unnecessary to utilize a locking base in conjunction with a counter display since the display arms of existing counter displays are not removable. A removable display arm, however, is advantageous to permit the display arm and items of merchandise to be rapidly replaced or re-positioned on the counter display instead of removing and replacing each item of merchandise. A locking end assembly would provide the further advantage of securing the items of merchandise on the display arm such that a prospective shoplifter cannot remove any of the items of merchandise from the display arm. A locking end assembly that permits bulk unloading of items of merchandise and bulk loading of merchandise would provide an even further advantage to allow store personnel to rapidly remove and restock items of merchandise onto the display arm. In summary, a counter display including a lockable display arm, and in particular, a display arm having a locking base in combination with a locking end assembly, provides numerous advantages that are not provided by any known counter display.

Accordingly, there exists a need for an apparatus for securely displaying items of merchandise on a counter, table, shelf or similar generally horizontal support surface. There exists a further, and more specific, need for a counter display including at least one lockable display arm for securely displaying items of merchandise suspended from the display arm. In particular, there exists a need for a display arm that is configured to be locked onto a pedestal of a counter display and includes a locking end assembly for preventing unauthorized removal of the items of merchandise from the display arm, while permitting bulk loading of items of merchandise onto the display arm and bulk unloading of the items from the display arm.

DETAILED DESCRIPTION OF PREFERRED EMBODIMENTS OF THE INVENTION

Figure 1:
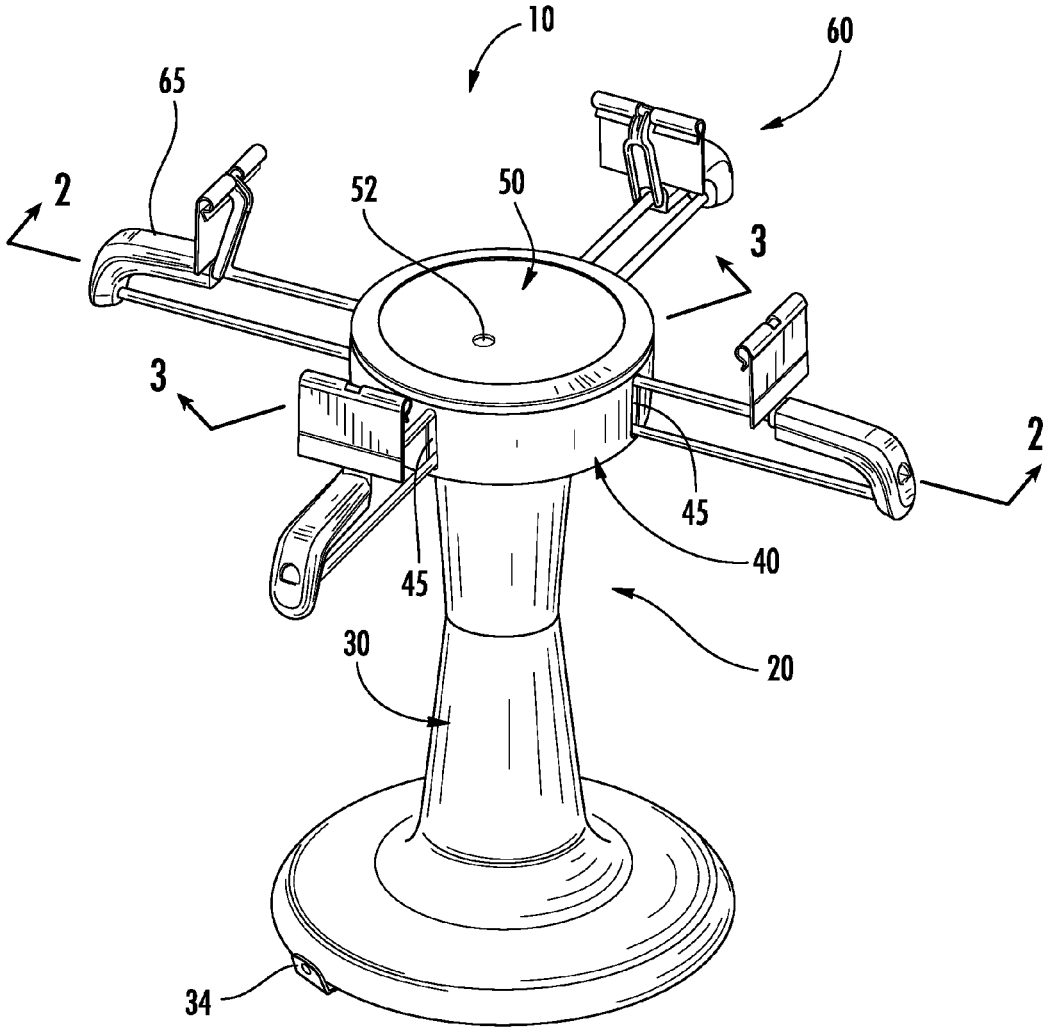
FIG. 1 is a perspective view of a counter display including a lockable display arm according to the invention.

The accompany drawing figures illustrate one or more exemplary embodiments of a counter display, indicated generally at 10, for securely displaying items of merchandise on a generally horizontal support surface, such as a counter, table, shelf or the like (not shown). As shown herein, the counter display 10 comprises a pedestal or support member, indicated generally at 20, having a lower portion 30, an upper portion 40 rotatably supported on the lower portion, and a lockable cover 50 removably mounted on the upper portion. The counter display 10 further comprises at least one, and preferably a plurality, of lockable display arms 60 removably disposed on the upper portion 40 of the pedestal 20. Each display arm 60 comprises a locking end assembly 65 movably disposed on the display arm. A first lock mechanism is provided for releasably locking the cover 50 to the upper portion 40 of the pedestal 20. A second lock mechanism is provided for releasably locking the display arms 60 to the upper portion 40 of the pedestal 20. A third lock mechanism is provided for releasably locking the end assembly 65 to the display arm 60.

Figure 2:
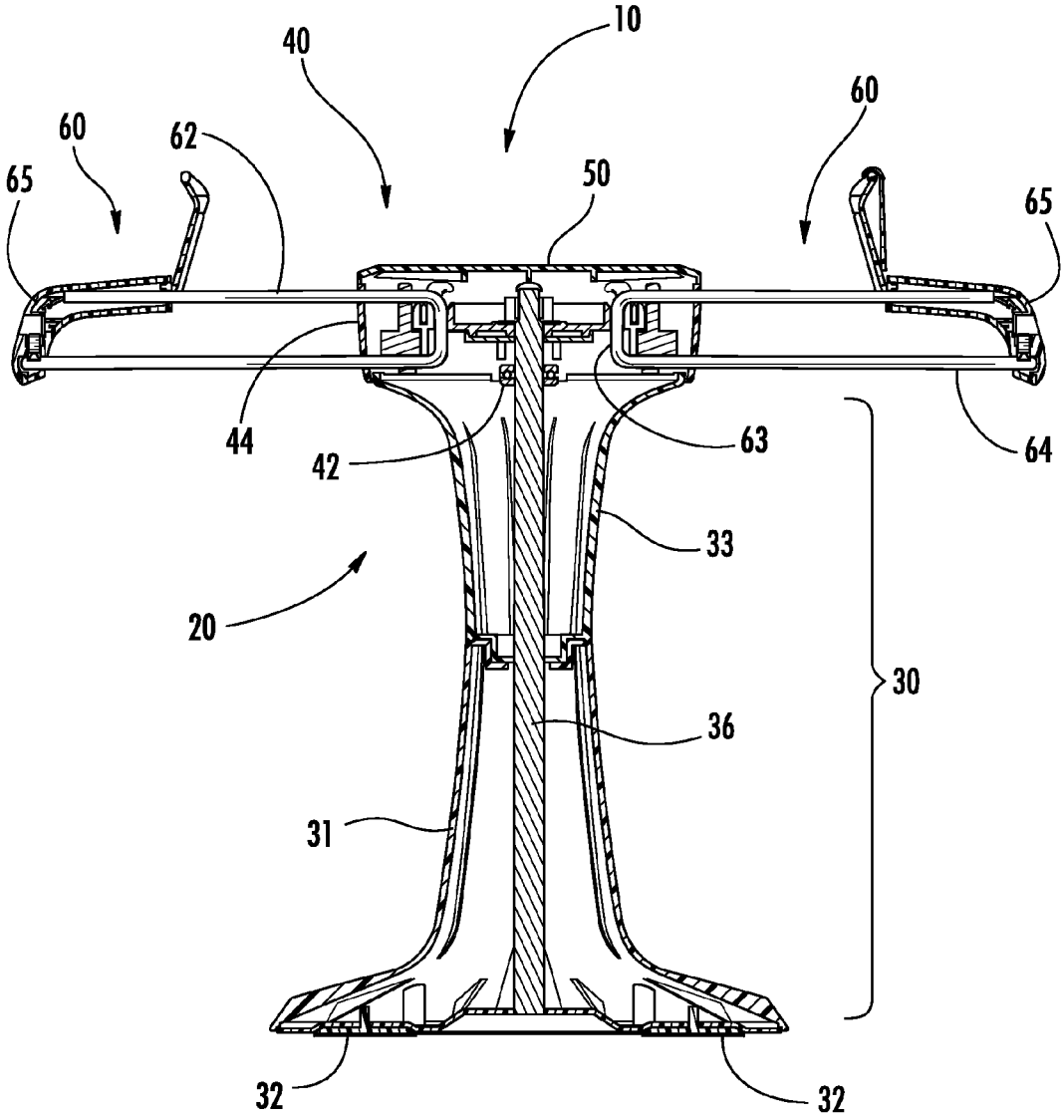
FIG. 2 is a vertical section view of the counter display of FIG. 1 taken along the line 2-2 of FIG. 1.

FIG. 1 shows an exemplary embodiment of a counter display 10 including a lockable display arm 60 according to the invention. FIG. 2 is a vertical section view of the counter display 10 shown in FIG. 1. The counter display 10 comprises a pedestal 20 having a lower portion 30 configured for being positioned on a generally horizontal support surface, such as a counter, table, shelf or the like. The lower portion 30 of the pedestal 20 may be merely supported, but not affixed, on the support surface so that the counter display 10 can be positioned at any desired location on the support surface. If desired, a relatively thin layer of an anti-skid material, for example polystyrene, foam or rubber, may be provided on the underside of the lower portion 30 of the pedestal 20 to prevent the counter display 10 from sliding on the support surface. However, typically the lower portion 30 of the pedestal 20 is secured to the support surface at a desired location. The lower portion 30 may be secured to the support surface by a relatively thin layer of an adhesive material 32, for example a pressure sensitive adhesive (PSA) such as double-sided tape. In a preferred embodiment, the double-sided tape is adhered on its inner face to a foot member (not shown) that is removably attached to the underside of the lower portion 30, for example by a threaded stud. In this manner, the foot member(s) and PSA may be omitted, or can be replaced in the event the counter display 10 must be detached and repositioned on the support surface. Alternatively, the lower portion 30 may be secured to the support surface by mechanical fasteners, for example wood screws, nails or threaded bolts and nuts (not shown). In another embodiment, an attachment flange 34 may be affixed to the lower portion 30 of the pedestal 20, for example by welding or brazing, and configured for attachment in a known manner to a generally vertical surface, such as a wall or upright of a shelf, book case or the like. As shown herein, the lower portion 30 is formed of a tapered first section 31 and a generally inverse tapered second section 33. Forming the lower portion 30 of the pedestal 20 in two sections permits the height of the pedestal to be varied by using one of a plurality of different second sections 33 mated with a standard height first section 31 (or visa-versa) so that the counter display 10 may have any desired height and aesthetics. The second section 33 may be mechanically coupled to the first section 31 in any suitable manner. If desired, the second section 33 may be rotatable relative to the first section 31 and/or the entire lower portion 30 may be rotatable relative to the support surface.

Regardless, the pedestal 20 further has an upper portion 40 that is rotatably supported on the lower portion 30. In the exemplary embodiments shown herein, pedestal 20 comprises a centrally disposed shaft 36 that extends vertically upward from the lower portion 30 of the pedestal into the upper portion 40. As shown in FIG. 2, an annular bearing 42 disposed within the upper portion 40 of the pedestal 20 is positioned on the shaft 36 to permit the upper portion to rotate freely relative to the lower portion 30. Although a conventional ball bearing ring is illustrated, any suitable means for rotatably coupling the upper portion 40 to the lower portion 30 may be utilized, including but not limited to low friction materials. Furthermore, the upper portion 40 may be fixed to the lower portion 30, for example if the second section 33 of the lower portion is rotatably coupled to the first section 31, or alternatively, if the retailer desires the display arms 60 to remain in a fixed location on the counter display 10. As shown, the upper portion 40 defines a cylindrical, generally hollow, housing 44 having a plurality of slots 45 (FIG. 1) formed therethrough at predetermined spaced-apart intervals around the outer periphery of the housing. Each slot 45 is sized and shaped to receive an inner mounting end 63 of one of the display arms 60, as will be described further hereafter. In the embodiments shown and described herein, the slots 45 are formed in a generally vertical orientation and sized to receive the mounting end 63 of a two-wire display arm 60 comprising an elongate upper rod 62 and an elongate lower rod 64. Slots 45, however, may be formed in any orientation, including generally horizontal, so that the housing 44 of the upper portion 40 of the pedestal 20 is configured to receive the mounting end of a U-shaped display arm of a security fixture commercially known as a "Geck-style" merchandise display hook.

Figure 3:
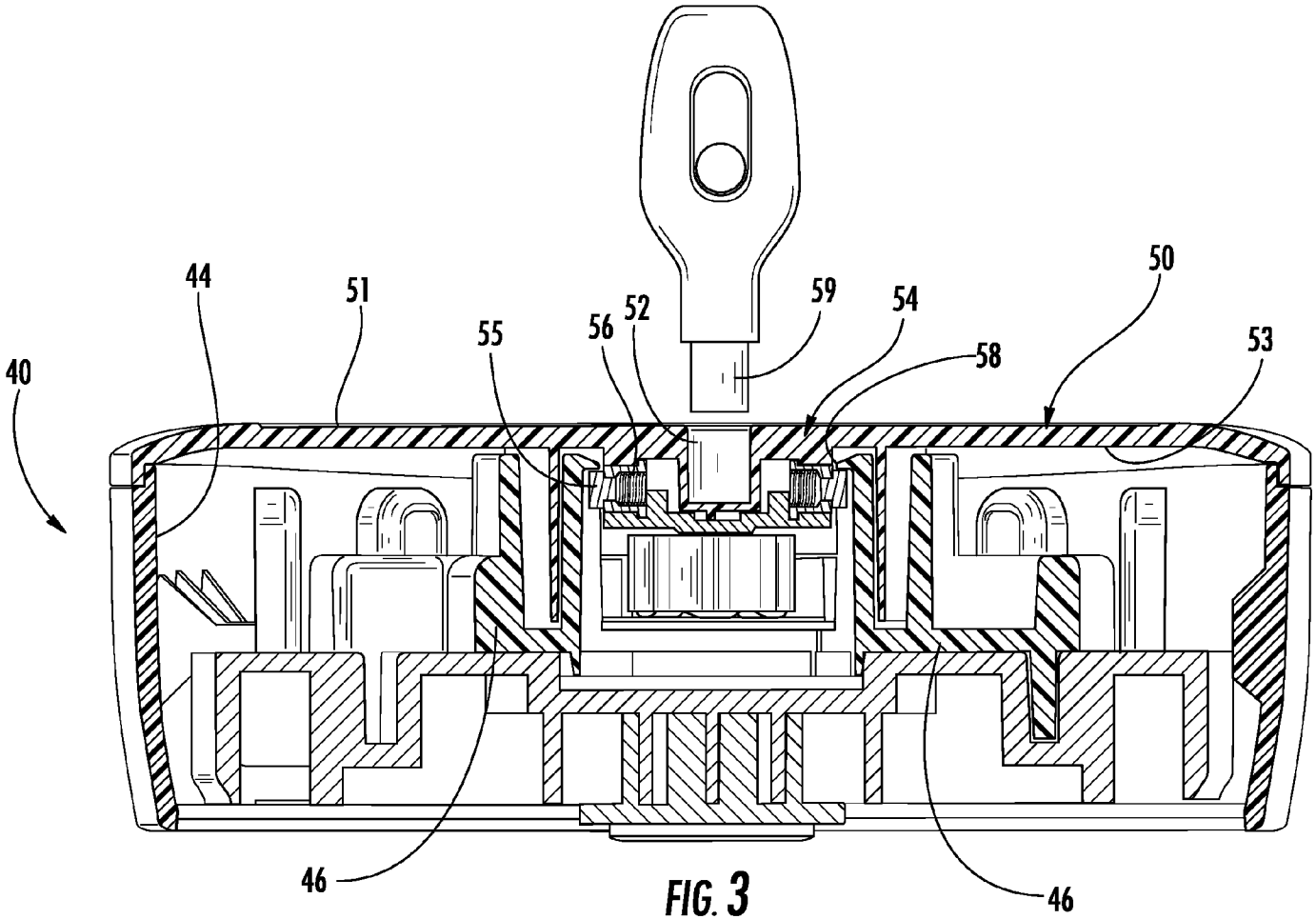
FIG. 3 is an enlarged vertical section view of the upper portion of the pedestal of the counter display of FIG. 1 taken along the line 3-3 of FIG. 1 and shown with the remainder of the pedestal and the display arms removed for purposes of clarity.

FIG. 3 is an enlarged vertical section view of the upper portion 40 of the counter display 10. The upper portion 40 of the pedestal 20 is configured to receive removable and lockable cover 50. A first lock mechanism is provided for releasably locking the cover 50 on the upper portion 40. In the embodiments shown and described herein, a recess 52 is formed in the top surface 51 of the cover 50 and a lock mechanism 54 is disposed on the bottom (i.e. underside) surface 53 of the cover. Lock mechanism 54 comprises at least one shuttle 55 made of a magnetically attractable material, such as metal, that is biased outwardly by a conventional compression spring 56 in its relaxed (extended) position. In the extended configuration, shuttle 55 engages the underside of a ledge or lip 58 formed on a lock ring 46 that is disposed within the generally hollow interior of the housing 44 of the upper portion 40. As shown herein, the lock mechanism 54 comprises a pair of outwardly biased shuttles 55 disposed opposite one another. A specially configured magnet 59 is insertable into the recess 52 to attract the shuttles 55 inwardly against the biasing force exerted by the corresponding spring 56. The magnetic attraction force introduced by the magnet causes the shuttles 55 to move out of engagement with the lips 58 of the lock ring 46 so that the cover 50 may be lifted off the upper portion 40 of the pedestal 20. As the cover 50 is replaced onto the housing 44 of the upper portion 40, the lip 58 forces the corresponding shuttle 55 inwardly against the biasing force of the spring 56 until the shuttles pass the lip. The spring 56 thereafter bias the shuttle 55 outwardly into engagement with the underside of the lip 58. Alternatively, the magnet 59 may be maintained within the recess 52 until the cover 50 is replaced on the upper portion 40. When the magnet 59 is removed from the recess 52, the shuttles 55 will again engage the underside of the lips 58 of the lock ring 46. If desired, lock mechanism 54 on cover 50 may be configured to be received on upper portion 40 in only one orientation relative to lock ring 46. Furthermore, cover 50 may be configured to be locked on upper portion 40 only when the lock ring 46 is in a predetermined position, for example a locked position, as will be described hereafter.

Figure 4A:
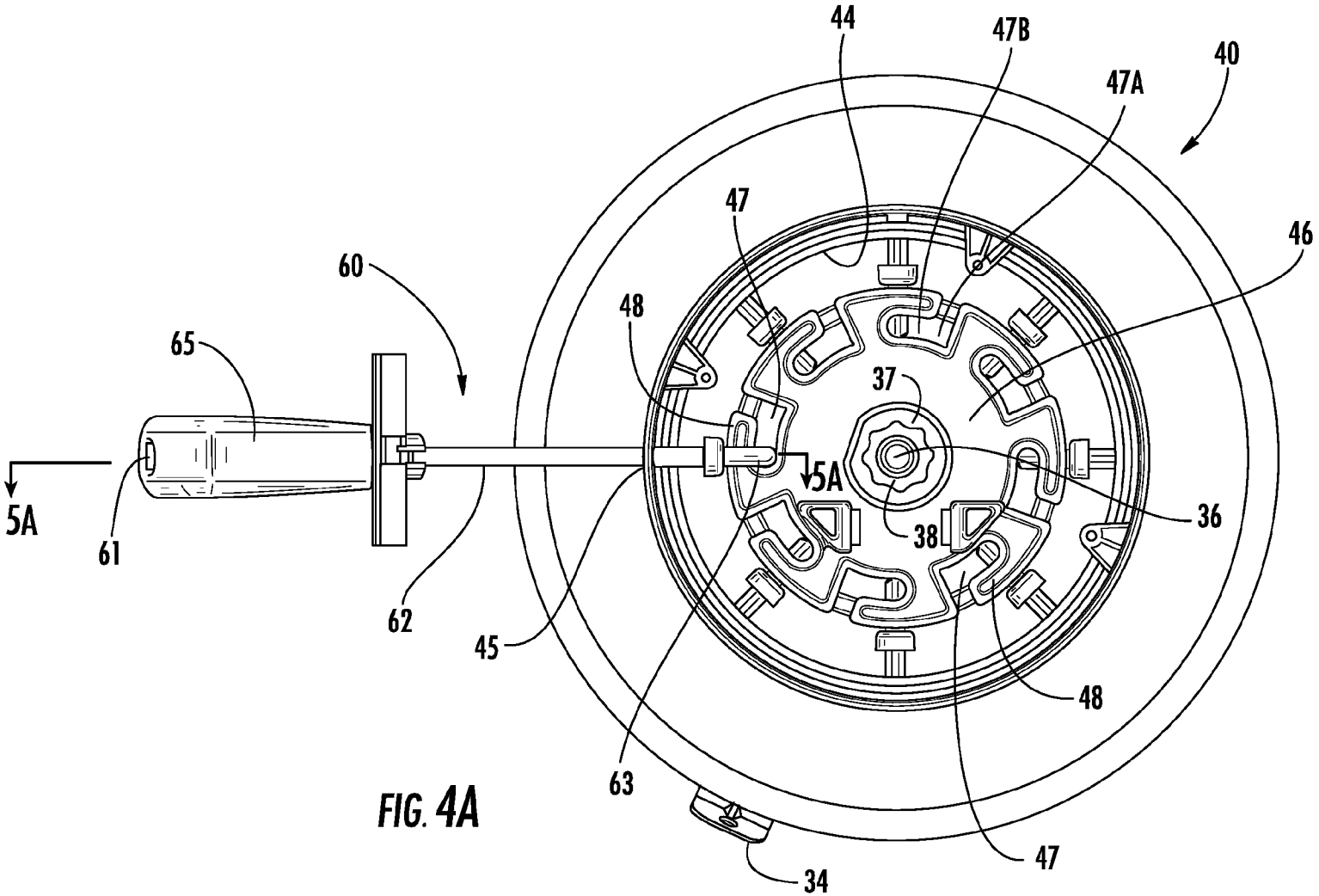
FIG. 4A is a top view of the upper portion of the pedestal of the counter display of FIG. 1 shown with the cover removed for purposes of clarity and with a typical display arm in a locked position.
Figure 4B:
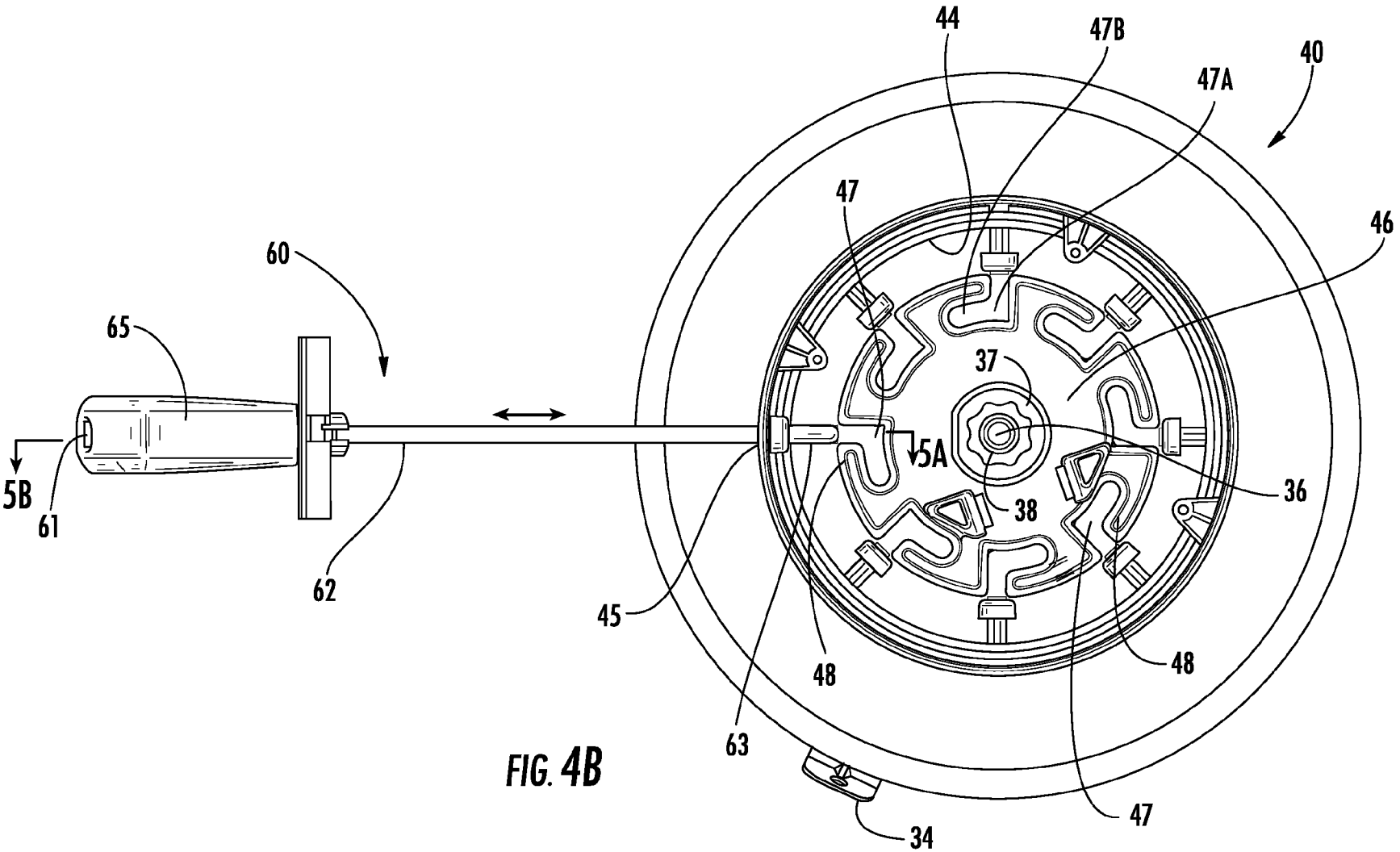
FIG. 4B is a top view of the upper portion of the pedestal of the counter display of FIG. 4A shown with the typical display arm in an unlocked position.

FIG. 4A and FIG. 4B are each a top view of the counter display 10 shown with the cover 50 removed for purposes of clarity. FIG. 4A illustrates lock ring 46 and a typical one of the display arms 60 in a locked position on the upper portion 40 of the pedestal 20, while FIG. 4B illustrates the lock ring 46 and the typical display arm 60 in an unlocked position. A second lock mechanism is provided for releasably locking each display arm 60 on the upper portion 40 of the pedestal 20. In the embodiments shown and described herein, the lock ring 46 is rotatably disposed within the generally hollow interior of housing 44 of the upper portion 40. Lock ring 46 is rotatably mounted on the shaft 36 of the pedestal 20 and secured thereto by a conventional frictionless washer 37 and nut 38. As such, lock ring 46 is rotatable relative to housing 44 of upper portion 40 between a locked position (FIG. 4A) and an unlocked position (FIG. 4B). The mounting end 63 of each display arm 60 is inserted through one of the slots 45 formed through the housing 44 and into a generally L-shaped slot 47 formed in the lock ring 46. Slot 47 comprises a radially-extending portion 47A for receiving mounting end 63 and a circumferentially-extending portion 47B for locking the mounting end 63 within the housing 44. Lock ring 46 is rotated a relatively small amount, for example between about ten degrees) (10°) and about thirty degrees (30°) from the unlocked position (FIG. 4B) to the locked position (FIG. 4A) so that the mounting end 63 of each display arm 60 is entrapped by a finger 48 of the lock ring. As a result, rotation of the lock ring 46 simultaneously locks all of the display arms 60 disposed in slot 47 onto the upper portion 40 of the pedestal 20. Likewise, rotation of the lock ring 46 in the opposite direction simultaneously unlocks all of the display arms 60 from the pedestal 20. With the pedestal 20 in a display configuration, a display arm 60 cannot be removed from the pedestal without first unlocking and removing cover 50 using lock mechanism 54, as previously described, to access lock ring 46 within housing 44 of upper portion 40, and thereafter, rotating lock ring 46 from the locked position (FIG. 4A) to the unlocked position (FIG. 4B). Lock ring 46 is moved from the locked position to the unlocked position by rotating the lock ring a relatively small amount (e.g. between about ten degrees (10°) and about thirty degrees (30°)) in the opposite direction. In the unlocked position, each display arm 60 can be withdrawn through the corresponding slot 45 formed through the housing 44 of the upper portion 40 of the pedestal 20. In this manner, a display arm 60 can be rapidly removed and replaced, or alternatively, can be repositioned at another location on the housing 44 of the upper portion 40.

Figure 5A:
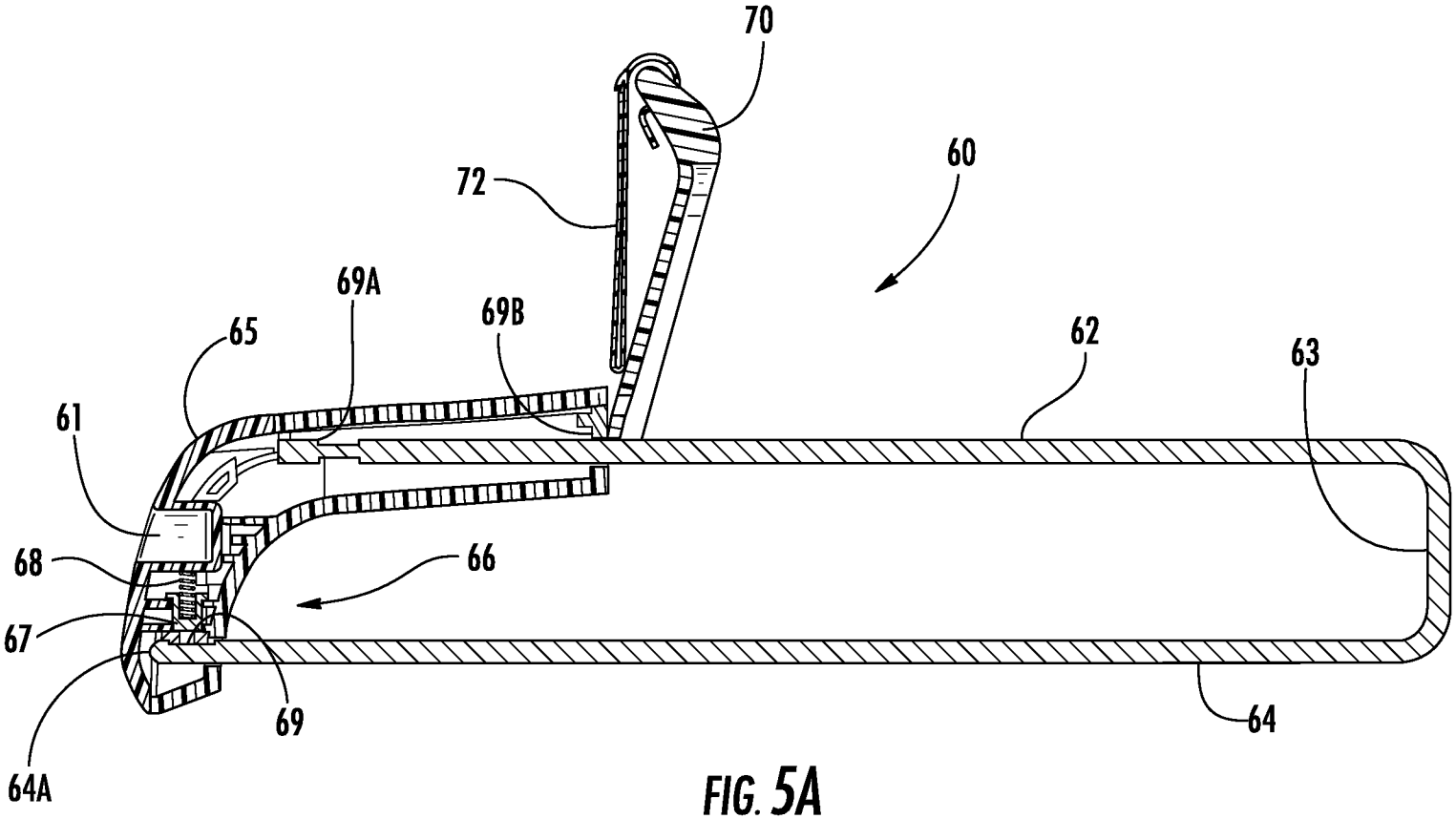
FIG. 5A is a vertical section view of the typical display arm of FIG. 4A taken along the line 5A-5A and shown with a locking end assembly according to the invention in a locked position.
Figure 5B:
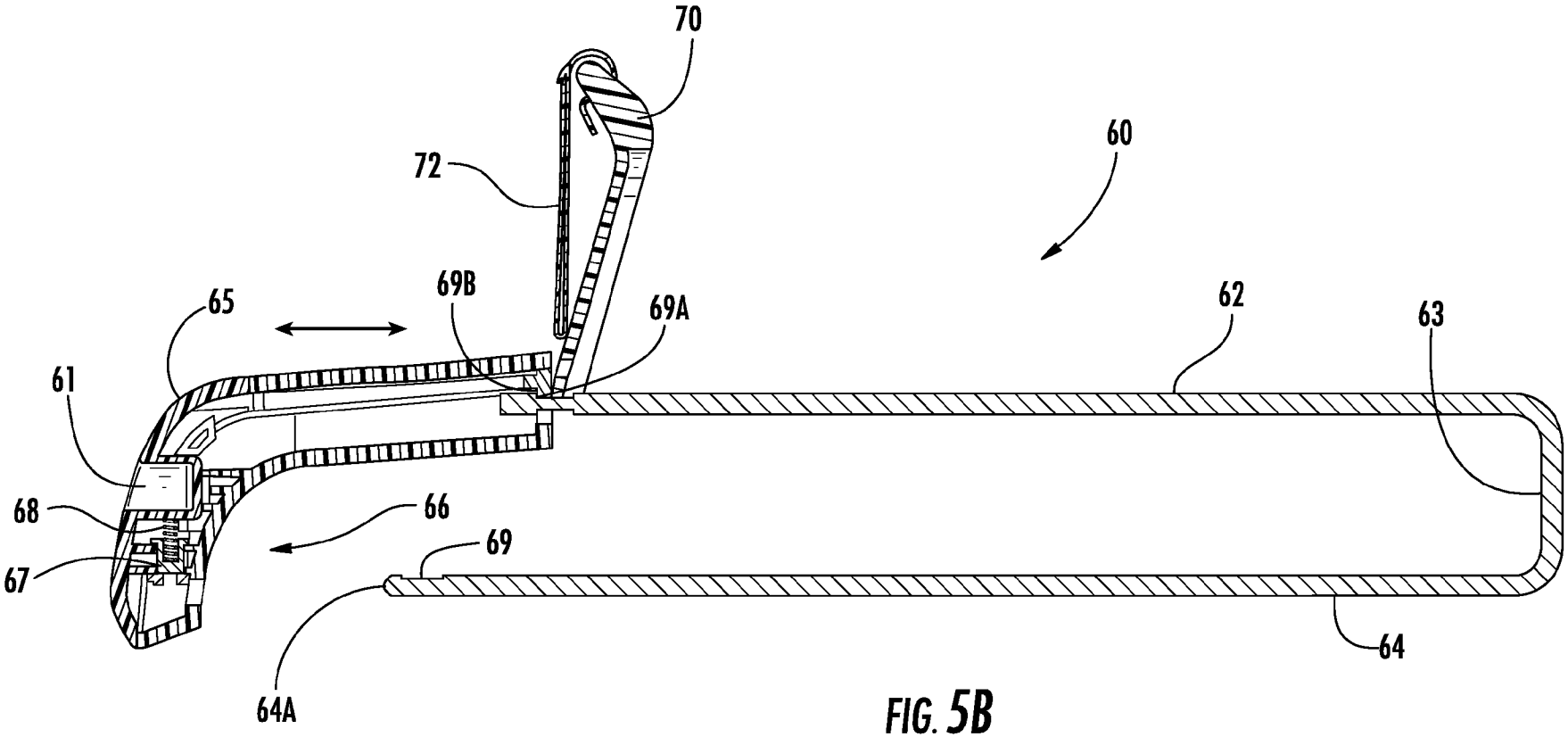
FIG. 5B is a vertical section view of the typical display arm of FIG. 5A shown with the locking end assembly in an unlocked position.

FIG. 5A and FIG. 5B are each a vertical section view of a typical one of the display arms 60 disposed on the counter display 10 shown with the pedestal 20 removed for purposes of clarity. FIG. 5A illustrates the end assembly 65 of the typical display arm 60 in a locked position, while FIG. 5B illustrates the end assembly 65 of the typical display arm 60 in an unlocked position. The display arm 60 may be any style or type of merchandise display arm, wire, hook, rod or the like configured for supporting one or more items of merchandise to be displayed on a support surface, such as a counter table, shelf, desk or the like, including a one-wire, two-wire or Geck-style display hook. As shown herein, display arm 60 comprises elongate upper rod 62 and elongate lower rod 64 joined together by mounting end 63, as previously described. In operation, upper rod 62 and lower rod 64 are typically disposed in a generally horizontal orientation and mounting end 63 is typically disposed in a generally vertical orientation. Locking end assembly 65 is movably disposed on the display arm 60, and in particular on the lower rod 64, for preventing the unauthorized removal of items of merchandise from the display arm. The locking end assembly 65 is releasably locked on the lower rod 64 and is movable relative to the remainder of the display arm 60 between a locked position (FIG. 5A) and an unlocked position (FIG. 5B). A third lock mechanism 66 is provided for releasably locking the end assembly 65 to the lower rod 64 of the display arm 60. In the embodiments shown and described herein, a recess 61 formed in the exterior of the locking end assembly 65 extends in a generally horizontal direction towards the mounting end 63 of the display arm 60. The third lock mechanism 66 is disposed within the locking end assembly 65 and comprises a shuttle 67 made of a magnetically attractable material, such as metal, that is biased outwardly (downwardly as depicted in FIG. 5A) in the direction of the lower rod 64 of display arm 60 by a conventional compression spring 68 in its relaxed (extended) position. In the extended configuration, the shuttle 67 engages a lateral undercut, groove or relief 69 formed in the upper surface of the lower rod 64.

A specially configured magnet 59 (FIG. 3) is insertable into the recess 61 to attract the shuttle 67 inwardly (upwardly as depicted in FIG. 5B) against the biasing force exerted by the spring 68. The magnetic attraction force introduced by the magnet 59 causes the shuttle 67 to move out of engagement with the relief 69 formed in the lower rod 64 so that the end assembly 65 may be moved in a generally horizontal direction away from the mounting end 63 of the display arm 60. With the end assembly 65 moved from the locked position (FIG. 5A) to the unlocked position (FIG. 5B), one or more items of merchandise suspended from lower rod 64 of display arm 60 may be removed, or alternatively, one or more items of merchandise may be loaded (i.e. stocked) onto the lower rod. In this manner, sales personnel may remove items of merchandise from the counter display 10 for sale to a purchaser, or alternatively, may restock items of merchandise onto the lower rod 64 by bulk unloading and bulk loading, respectively. A mechanical stop 69A and 69B may also be provided for retaining the locking end assembly 65 on the display arm 60 in the unlocked position. When end assembly 65 is moved in the direction of the mounting end 63 back onto lower rod 64, a beveled forward edge 64A of the lower rod forces the shuttle 67 inwardly (upwardly as depicted in FIG. 5B) against the biasing force of spring 68 until the shuttle again engages the relief 69. Spring 68 thereafter bias the shuttle 67 outwardly (downwardly as depicted in FIG. 5B) into engagement with the relief 69. Alternatively, magnet 59 may be maintained within recess 61 until the locking end assembly 65 is repositioned onto the lower rod 64 of the display arm 60 in the locked position. When magnet 59 is removed from recess 61, the shuttle 67 will again engage the relief 69. If desired, the display arm 60 may be provided with an optional label holder 70 and label 72 for displaying printed indicia (e.g. price) relating to the items of merchandise suspended from the lower rod 64.

The foregoing has described one or more exemplary embodiments of a counter display 10 for displaying items of merchandise on a support surface including at least one lockable display arm 60 according to the invention. Each lockable display arm 60 is locked onto a pedestal 20 of the counter display 10 and includes a locking end assembly 65 for preventing unauthorized removal of the items of merchandise from the display arm 60, while permitting bulk loading of items of merchandise onto the display arm and bulk unloading of items of merchandise from the display arm. Preferred embodiments of the counter display 10 and lockable display arm 60 have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A display for displaying items of merchandise, comprising:

a support member adapted to be positioned on a support surface;

a plurality of display arms removably disposed on the support member, each display arm comprising an elongate rod for supporting the items of merchandise and a mounting end adapted to be received on the support member, wherein each rod has a free end for loading the items of merchandise on the display arm and for removing the items of merchandise from the display arm;

a first lock mechanism disposed within the support member and configured to engage, and releasably lock, the mounting end of each of the display arms on the support member;

a plurality of end assemblies, each end assembly disposed on a respective display arm adjacent the free end of each rod and independently movable between a locked position for preventing items of merchandise from being removed from each rod and an unlocked position for permitting items of merchandise to be removed from each rod; and a plurality of second lock mechanisms, each second lock mechanism configured to releasably lock a respective end assembly on each display arm.

2. A display according to claim 1, wherein the first lock mechanism comprises a lock ring movably mounted on the support member and wherein the lock ring is movable between an unlocked position and a locked position in which the mounting end of each display arm is locked on the support member.

3. A display according to claim 2, wherein the lock ring has a least one slot formed therein and wherein the slot comprises a radially-extending portion and a circumferentially-extending portion that define a finger for entrapping the mounting end of each display arm on the lock ring in the locked position.

4. A display according to claim 2, wherein the lock ring is rotatably mounted on the support member and wherein the lock ring is moveable between about ten degrees (10°) and about thirty degrees (30°) from the unlocked position to the locked position.

5. A display according to claim 2, wherein the support member comprises a generally hollow housing having a plurality of slots formed therethrough and wherein each slot is configured to receive the mounting end of each display arm.

6. A display according to claim 5, wherein the housing is rotatably mounted on the support member and wherein the lock ring is rotatably disposed within the housing.

7. A display according to claim 5, further comprising a lockable cover adapted to be removably mounted on the housing and a third lock mechanism for releasably locking the cover on the housing.

8. A display according to claim 7, wherein the lock ring has at least one lip formed thereon and wherein the third lock mechanism for locking the cover on the housing comprises at least one shuttle that is biased into engagement with the lip.

9. A display according to claim 8, wherein the shuttle is made of a magnetically attractable material and wherein the cover defines a recess configured to receive a magnet for attracting the shuttle from a locked position in which the shuttle engages the lip to an unlocked position in which the shuttle does not engage the lip so that the cover is removable from the housing.

10. A display according to claim 1, wherein each rod has a relief formed therein and wherein each second lock mechanism for locking a respective end assembly on each display arm comprises at least one shuttle that is biased into engagement with the relief.

11. A display according to claim 10, wherein the shuttle is made of a magnetically attractable material and wherein each end assembly defines a recess configured to receive a magnet for attracting the shuttle from a locked position in which the shuttle engages the relief to an unlocked position in which the shuttle does not engage the relief and each end assembly is movable on a respective display arm.

12. A display according to claim 1, wherein the support member comprises a generally hollow housing having a plurality of slots formed therethrough and wherein each slot is configured to receive a mounting end of a respective display arm.

13. A counter display according to claim 12, further comprising a lockable cover adapted to be removably mounted on the housing and a third lock mechanism for releasably locking the cover on the housing.

14. A display according to claim 13, the housing has at least one lip formed thereon and wherein the third lock mechanism for locking the cover on the housing comprises at least one shuttle that is biased into engagement with the lip.

15. A display according to claim 14, wherein the shuttle is made of a magnetically attractable material and wherein the cover defines a recess configured to receive a magnet for attracting the shuttle from a locked position in which the shuttle engages the lip to an unlocked position in which the shuttle does not engage the lip so that the cover is removable from the housing.

16. A display according to claim 1, wherein each end assembly is configured to be moved between the locked position and the unlocked position while the first lock mechanism is locking each mounting end of the display arm on the support member.

17. A display according to claim 1, wherein the first lock mechanism is rotatably disposed within the support member and is configured to engage the mounting end of each display arm when the first lock mechanism is locking the mounting end on the support member.

18. A display for displaying items of merchandise, comprising:

a support member adapted to be positioned on a support surface;

a plurality of display arms removably disposed on the support member, each display arm comprising an elongate rod for supporting the items of merchandise and a mounting end adapted to be received on the support member, wherein each rod has a free end for loading the items of merchandise on the display arm and for removing the items of merchandise from the display arm;

a plurality of end assemblies, each end assembly disposed on a respective display arm and independently movable between a locked position for preventing items of merchandise from being removed from the free end of each rod and an unlocked position for permitting items of merchandise to be removed from the free end of each rod, wherein each end assembly comprises a lock mechanism configured to releasably lock to a respective display arm.

* * * * *